US011052976B2

(12) United States Patent
O'Rourke

(10) Patent No.: US 11,052,976 B2
(45) Date of Patent: Jul. 6, 2021

(54) WAVE RIDING BOARDS

(71) Applicant: Alverno Management Company, Swarthmore, PA (US)

(72) Inventor: Steve O'Rourke, Waretown, NJ (US)

( * ) Notice: Subject to any disclaimer, the term of this patent is extended or adjusted under 35 U.S.C. 154(b) by 7 days.

(21) Appl. No.: 16/591,373

(22) Filed: Oct. 2, 2019

(65) Prior Publication Data

US 2020/0031435 A1 Jan. 30, 2020

Related U.S. Application Data

(63) Continuation-in-part of application No. 15/848,848, filed on Dec. 20, 2017, now Pat. No. 10,435,120.

(51) Int. Cl.
*B63B 32/60* (2020.01)

(52) U.S. Cl.
CPC ..... *B63B 32/60* (2020.02)

(58) Field of Classification Search
CPC ... B63B 35/79; B63B 1/20; B63B 2035/7903; B63B 2001/202; B63B 35/7909
USPC ..... 441/74
See application file for complete search history.

(56) References Cited

U.S. PATENT DOCUMENTS

| | | | | |
|---|---|---|---|---|
| 3,111,695 | A | 11/1963 | Kelly, Jr. | |
| 6,007,393 | A * | 12/1999 | Choiniere | B63B 32/50 441/74 |
| 6,718,897 | B1 * | 4/2004 | De Bello | B63B 32/50 441/74 |
| 7,524,225 | B1 | 4/2009 | Richenberg et al. | |
| 2007/0051775 | A1 | 3/2007 | Lei | |
| 2008/0287018 | A1 * | 11/2008 | Johnson | B63B 32/60 441/74 |
| 2019/0185113 | A1 | 6/2019 | O'Rourke | |

* cited by examiner

*Primary Examiner* — Anthony D Wiest
(74) *Attorney, Agent, or Firm* — Quarles & Brady LLP

(57) ABSTRACT

A wave riding hoard is provided herein that has a body including a top, a bottom, a right edge, a left edge, a front, a rear and a length defined from the front to the rear. The bottom of the body includes one or more steps. A first channel is defined at least partially between the one or more steps. The first channel extends along at least a portion of the length of the body. At least one of the one or more steps extends at least partially around the left edge or the right edge of the body.

23 Claims, 12 Drawing Sheets

WAVE RIDING BOARDS

CROSS-REFERENCE TO RELATED APPLICATION

This application is a continuation of U.S. patent application Ser. No. 15/848,848 entitled "WAVE RIDING BOARDS," filed on Dec. 20, 2017, the entire disclosure of Which is incorporated herein by reference.

BACKGROUND

The present disclosure relates generally to wave riding boards and to wave riding, and more specifically to surfboards and surfing. Riding waves in water is a popular recreation that involves riding a board that travels along or across water, including any waves or currents produced by the water. New and improved wave riding boards that enhance the appeal of wave riding, improve the ease and simplicity of using such boards, and increase the overall wave riding experience are needed.

SUMMARY OF THE INVENTION

According to some aspects of the present disclosure, a wave riding board has a body including a top, a bottom, a right edge, a left edge, a front, a rear and a length defined from the front to the rear. The bottom of the body includes one of more steps and a first channel defined at least partially between the one or more steps. The first channel extends along at least a portion of the length of the body. At least one of the one or more steps extends at least partially around the left edge or the right edge of the body.

According to some aspects of the present disclosure, a wave riding board has a body including a top, a bottom, a right edge, a left edge, a front, a rear and a length defined from the front to the rear. The bottom of the body includes one or more steps. The body defines one or more notches in at least one of the right edge or the left edge between the rear and the one or more steps.

According to some aspects of the present disclosure, a wave riding board has a body including a top, a bottom, a right edge, a left edge, a front, a rear and a length defined from the front to the rear. The bottom of the body includes one or more steps and a pair of channels defined at least partially between the one or more steps. A first channel is positioned on a first side of a central axis of the body and a second channel is positioned on a second side of the central axis.

These and other aspects, objects, and features of the present invention will be understood and appreciated by those skilled in the art upon studying the following specification, claims, and appended drawings.

Figure 1:
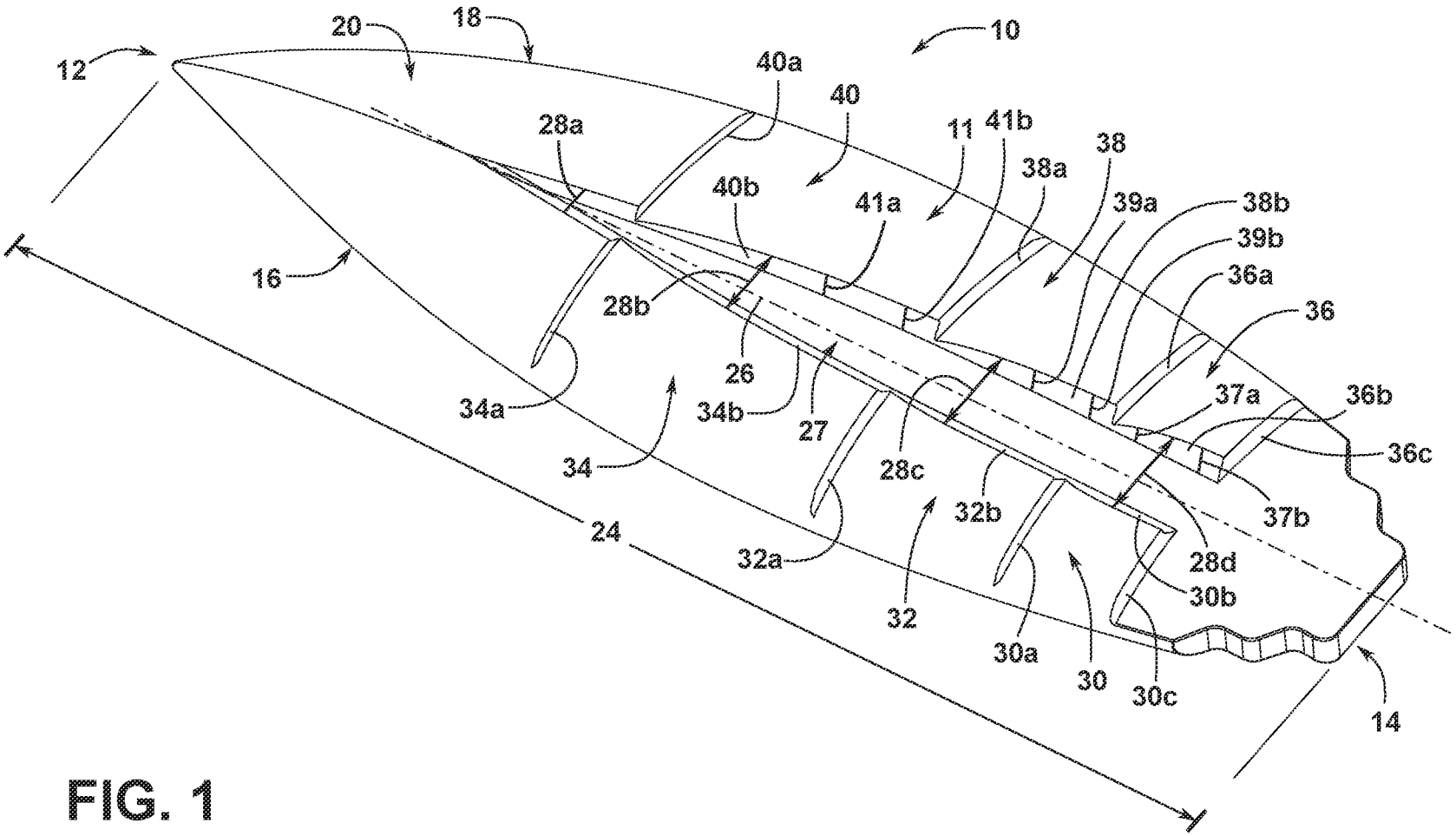
FIG. 1 illustrates a perspective view of a wave riding board according to one embodiment of the present disclosure.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures may not be depicted to scale. For example, the dimensions of some of the elements in the figures may be exaggerated relative to other elements to help improve understanding of embodiments of the present disclosure.

DESCRIPTION

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary examples of the inventive concepts defined in the appended claims. Hence, specific dimensions and other physical characteristics relating to the examples disclosed herein are not to be considered as limiting, unless the claims expressly state otherwise.

As required, detailed examples of the present invention are disclosed herein. However, it is to be understood that the disclosed examples are merely exemplary of the invention that may be embodied in various and alternative forms. The figures are not necessarily to a detailed design and some schematics may be exaggerated or minimized to show function overview. Therefore, specific structural and functional details disclosed herein are not to be interpreted as limiting, but merely as a representative basis for teaching one skilled in the art to variously employ the present invention.

In this document, relational terms, such as first and second, top and bottom, and the like, are used solely to distinguish one entity or action from another entity or action, without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

As used herein, the term "and/or," when used in a list of two or more items, means that any one of the listed items can be employed by itself; or any combination of two or more of the listed items can be employed. For example, if a composition or assembly is described as containing components A, B, and/or C, the composition or assembly can contain A alone; B alone; C alone; A and B in combination; A and C in combination; B and C in combination; or A, B, and C in combination.

As used herein, relational terms, such as "front," "rear," "right edge," "left edge," "bottom," or "top," shall mean any location proximate such portions of the wave riding board described herein. For example, a top of the wave riding board includes any location proximate to the top portion of the wave riding board. Accordingly, such terms are used to provide a general location of a described feature and are to be interpreted relative to one another in so much as the "front" of the board is forwardly of the "rear" of the board.

Figure 2:
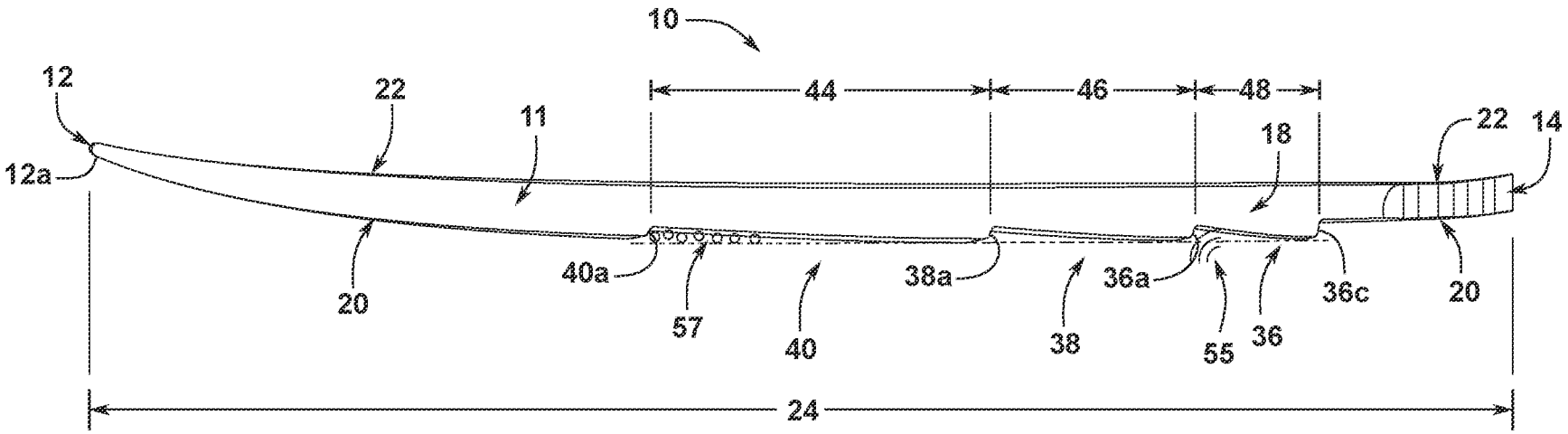
FIG. 2 illustrates a left side view of the wave riding board of FIG. 1.

FIGS. 1 and 2 illustrate one embodiment of a wave riding board 10 (e.g., a. surfboard, a bodyboard, and so on) according to the present disclosure. The wave riding board 10 includes a body 11 having a front 12, a rear 14, a right edge 16, a left edge 18, a bottom 20, a top 22 and a length 24 defined from the front 12 to the rear 14. A central longitudinal axis 26 is generally defined along or through a center of the body 11 and runs in a direction from the front 12 to the rear 14 of the body 11 (or the rear 14 to the front 12). The bottom 20 includes a channel 27 and a plurality of steps 30, 32, 34, 36, 38 and 40. The channel 27 is defined in or through a center portion of the bottom 20 and is between adjacent ones of the plurality of steps 30-40. The bottom 20 may be convexly shaped, may curve laterally from the right edge 16 to the left edge 18, and may curve longitudinally from the front edge 12 to the rear 14. The center portion of the body 11 may be thicker than right or left portions of the body 11 (i.e., the body 11 may be thinner going from the center to each of the right edge 16 and the left edge 18).

The plurality of steps 30-40 and channel 27 help prevent suction between the bottom 20 of the board 10 and the water on which the board 10 travels by creating breaks or voids between the bottom surface of the board 10 and the water. The breaks allow air to be distributed efficiently under the bottom 20 of the board 10. When the board 10 moves against current or waves in the water, air flows under the steps 30-40 of the board 10 to create lift while water simultaneously flows smoothly through the center channel 27 reducing the amount of energy or force required to paddle into the waves or current. When the board 10 moves with current or waves in the water (e.g., catching a wave in an ocean), water collides with lateral walls of the steps 30-40 to create additional thrust in the direction of the current or waves. The longitudinal distance between the lateral walls of the steps increases (going from the front 12 to the rear 14 of the board 10) to help eliminate hydrodynamic drag on the board 10. The reduction in drag occurs due to the volume of water under a first or front step (going from front to rear) being greater than a volume of water under a second or middle step, and/or the volume of water under the second or middle step being greater than a volume of water under a third or rear step (going from front to rear). The greater volume of water under the first step creates (relative to the second step) greater water pressure under the first step, which pushes away or clears the smaller and lighter volume of water under the second step. Likewise, the greater volume of water under the second step (relative to the third step) creates greater water pressure under the second step, which pushes away or clears the smaller and lighter volume of water under the third step (and so forth when there are more steps). This stepped configuration along with the spatially offset arrangement of steps having different longitudinal distances between the steps (described more below) advantageously reduces drag on the board 10 and improves the overall enjoyment of a person using the board 10.

Referring more specifically to the features illustrated in the embodiment of FIGS. 1 and 2, the plurality of steps 30-40 of the wave riding board 10 include a right front side step 34, a right middle side step 32, a right rear side step 30, and corresponding or adjacent left front side step 40, middle side step 38 and rear side step 36. Each of the right side steps 30, 32, 34 and respective adjacent left side steps 36, 38 and 40 are symmetrical or substantially symmetrical about the central longitudinal axis 26 of the body 11. The channel 27 is defined between each of the right side 30, 32, 34 and left side 36, 38 and 40 steps, and extends along a portion of the length 24 of the wave riding board 10. In the illustrated embodiment, the channel 27 extends through a center portion of the bottom 20 of the wave riding board 10 beyond the right front side step 34 and left front side step 40, terminating before the front 12 of the board 10. The channel 27 may in alternative embodiments be defined between any numbers of steps along the length 24 of the board 10 and may extend any portion of the length 24 of the board 10 including the entire length. The board 10 may include any suitable number of steps for providing the hydrodynamic advantages and enhanced riding experiences described herein. For example, in certain embodiments, instead of having three steps as illustrated in FIGS. 1 and 2 (i.e., the first step being the combined right and left front side steps 34, 40, the second step being the combined right and left middle side steps 32, 38 and the third step being the combined right and left rear side steps 30, 36, which combined steps can be either continuous steps or adjacent right and left side steps), wave riding board 10 may include only one step, only two steps, or four or more steps. The steps may include one or more of a single continuous front step, a single continuous middle step, or a single continuous rear step rather than separate left and right side steps. The channel 27 may be located between, or extend through, any suitable number of steps rather than be located between, or extend through, all of the plurality of steps. In certain embodiments, channel 27 may not be present at all (e.g., when each step is continuous rather than separate right and left side steps). In alternative embodiments, the wave riding board may include three or more steps for each side step and include more than one channel. For example, the wave riding board may include a first front pair of steps and second front pair of steps, a first middle pair of steps and a second middle pair of steps and a first pair of rear steps and a second pair or rear steps. A channel may run through or be defined between one or more of each of the first pair of front, middle and rear steps, while a separate channel may run though or be defined between one or more of the second front, middle and re pair of steps.

Referring more specifically to the plurality of steps 30-40 as illustrated in the embodiment of FIGS. 1 and 2, the right front side step 34 includes a front lateral wall 34*a* and a longitudinal wall 34*b*, the left front side step 40 includes a front lateral wall 40*a* and a longitudinal wall 40*b*, the right middle side step 32 includes a front lateral wall 32*a* and a longitudinal wall 32*b*, the left middle side step 38 includes a front lateral wall 38*a* and a longitudinal wall 38*b*, the right rear side step 30 includes a front lateral wall 30*a* and a longitudinal wall 30*b*, and the left rear side step 36 may include a front lateral wall 36*a* and a longitudinal wall 36*b*. The right rear side step 30 and left rear side step 36 may also include rear lateral walls 30*c* and 36*c*, respectively. In the illustrated embodiment, rear walls 30*c* and 36*c* define a rear edge or wall of the steps 30 and 36 respectively, and terminate in a rear portion of the board 10, which portion continues to extend further towards the rear 14 of the board 10. In alternative embodiments, the rear walls 30*c* and 36 may define the rear edge or rear wall of the board 10 itself.

Each of the front lateral walls 30*a*-40*a* extend in a generally caved shape or curved direction from the right edge 16 to the left edge 18 of the body 11, which can also be in a direction from the left edge 18 to the right edge 16. In certain embodiments, one or more of the front lateral walls 30*a*-40*a* may extend entirely across the body 11 from the right edge 16 to left edge 18 (which can also be a direction from the left edge 18 to the right edge 16) or may extend only partially to the edges 16 or 18 in a direction running from the right edge 16 to left edge 18 (which can also be a direction running from the left edge 18 to the right edge 16). While each of the illustrated front lateral walls 30*a*-40*a* extend in a generally curved shape or curved direction from the right edge 16 to the left edge 18 of the body 11 (which can also be a direction from the left edge 18 to the right edge 16), in certain other embodiments, the walls 30*a*-40*a* may extend in a generally straight shape or straight direction from the right edge 16 to the left edge 18 of the body 11 (which can also be in a direction from the left edge 18 to the right edge 16). In one example, when the lateral walls 30*a*-40*a* are curved, a center portion of each lateral wall 30*a*-40*a* is positioned further from the rear 14 of the body 11 than the portions that extend closer to the right or left edges 16, 18. Each lateral wall 30*a*-40*a* may slope generally upwardly towards the center channel 27 or a center portion of the body 11, or generally increase in height from a respective edge 16 or 18 of the body 11 (or near the edge 16 or 18) to the center channel 27 or to a center portion of the body 11.

Each longitudinal wall 30*b*-40*b* is located near a center portion of the body 11 and inwardly from the respective right or left edge 16, 18, and extends in a generally upwardly sloping straight or curved fashion from a front lateral wall of the respective side step to the front lateral wall of the next step located closer to the rear 14 of the body 11 (or in the case of the step that is positioned closest to the rear 14 of the body 11, to a rear lateral wall of that same step or the rear edge of the body 11, e.g., longitudinal walls 30*b* and 36*b* of steps 30 and 36 extend to rear lateral walls 30*c* or 36*c*, respectively or to a rear edge of the body 11). In other words, for each longitudinal wall 30*b*-40*b*, the height of that longitudinal wall increases from the front 12 to the rear 14 of the body 11. For example, FIG. 1 illustrates the height of longitudinal wall 40*b* of the left side step 40 increasing from a front height of 41a to a rear height 41*b*, the height of longitudinal wall 38*b* of the left side step 38 increasing from a front height of 39a to a rear height 39*b*, the height of longitudinal wall 36*b* of the left side step 36 increasing from a front height of 37a to a rear height 37*b*. The heights of the longitudinal walls of the adjacent right side steps 34, 32 and 30 likewise have heights that increase from the front 12 to the rear 14 of the body 11. The channel 27 runs through or is defined at least partially between the longitudinal walls of each of the steps, and may have a width 28 that increases from the front 12 to the rear 14 of the body 11, thereby forming a longitudinally a substantially triangular or triangular-like shape. For example, the width 28 of channel 27 may gradually increase from width 28*a* at a front portion of the body 11, to a width 28*b* between longitudinal walls 40*a* and 34*a*, to a width 28*c* between longitudinal walls 38*a* and 32*a*, to a width 28*d* between longitudinal walls 36*b* and 30*b*. When the board 10 moves against the waves or current in the water, the lateral and longitudinal walls of each step 30-40 create individual voids or spaces under the steps 30-40 so that air (e.g., air 57 illustrated in FIG. 2) can flow under one or more of the steps 30-40 of the board 10 and create lift, while water can simultaneously flow smoothly through the center channel 27. When the board 10 moves with the waves or current in the water, the water (e.g., water 55 illustrated in FIG. 2) can collide with one or more of the lateral walls of the steps 30-40 to create additional thrust in the direction of the waves or current.

The front side steps, middle side steps and rear side steps (or single continuous steps) are spaced apart unevenly relative to each other in a longitudinal direction running from the front 12 to the rear 14 of the body 11 or the rear 14 to the front 12 of the body 11. That is, the amount of space created by respective walls (and defining surfaces created by the walls) for each step is different from each of the other steps. In the illustrated embodiment, the amount of space under the front step (which can be a single continuous step or one or more separate side steps like the right and left side steps), is greater than the amount of space under the middle step (which can also be a single continuous step or one or more separate side steps like the right and left side steps), and the amount of space under the middle step is greater than the amount of space under the rear step (which can also be a single continuous step or one or more separate side steps like right and left side steps).

In particular and referring to the embodiment illustrated in FIG. 2, the first step (e.g., left side step 40) includes a longitudinal distance 44 defined from the front lateral wall 40*a* of the left front side step 40 to the front lateral wall 38*a* of the left middle side step 38. The second step (e.g., left side step 38) includes a longitudinal distance 46 defined from the front lateral wall 38*a* of the left side step 38 to the front lateral wall 36*a* of the rear side step 36. The longitudinal distance 44 is greater than the longitudinal distance 46, Similarly, the third step (e.g., left side step 36) includes a longitudinal distance 48 defined from the front lateral wall 36*a* of the left side step 36 and a rear lateral wall 36*c* of the rear left side step 36 (or the edge of the board 10 in an alternative embodiment where the step(s) 36 are the rear edge of the board 10). The longitudinal distance 46 is greater than the longitudinal distance 48. Likewise, the right front side step 34, right middle side step 32 and right rear side step 30 each have the same or substantially the same longitudinal distances as illustrated in FIG. 2 for the respective left side steps 40, 38 and 36. The greater volume or space under the front step(s) relative to the middle or second step(s), and the greater volume or space under the second or middle step(s) relative to the third or rear step(s), helps to eliminate hydrodynamic drag on the board 10 due to the volume of water under the board 10 from the first step(s) to the second step(s) (going from front to rear) being greater than the volume of water under the board 10 from the second step(s) to the third step(s) or a rear wall of the second step (going from front to rear). The greater water volume under the front or first step or steps create greater water pressure under the front step or steps, which pushes clear the smaller and lighter volume of water under the second or middle steps, and the greater volume under the second, middle step relative to the third or rear step creates greater water pressure under the second or middle step, Which pushes clear the smaller and lighter volume of water under the third step. This advantageous hydrodynamic result occurs with any number of unevenly spaced apart steps according to the present disclosure. Likewise, it should be appreciated that the wall dimensions and/or longitudinal lengths for the steps of the present disclosure may be any suitable lengths or dimensions that provide the hydrodynamic advantages described herein.

Figure 3:
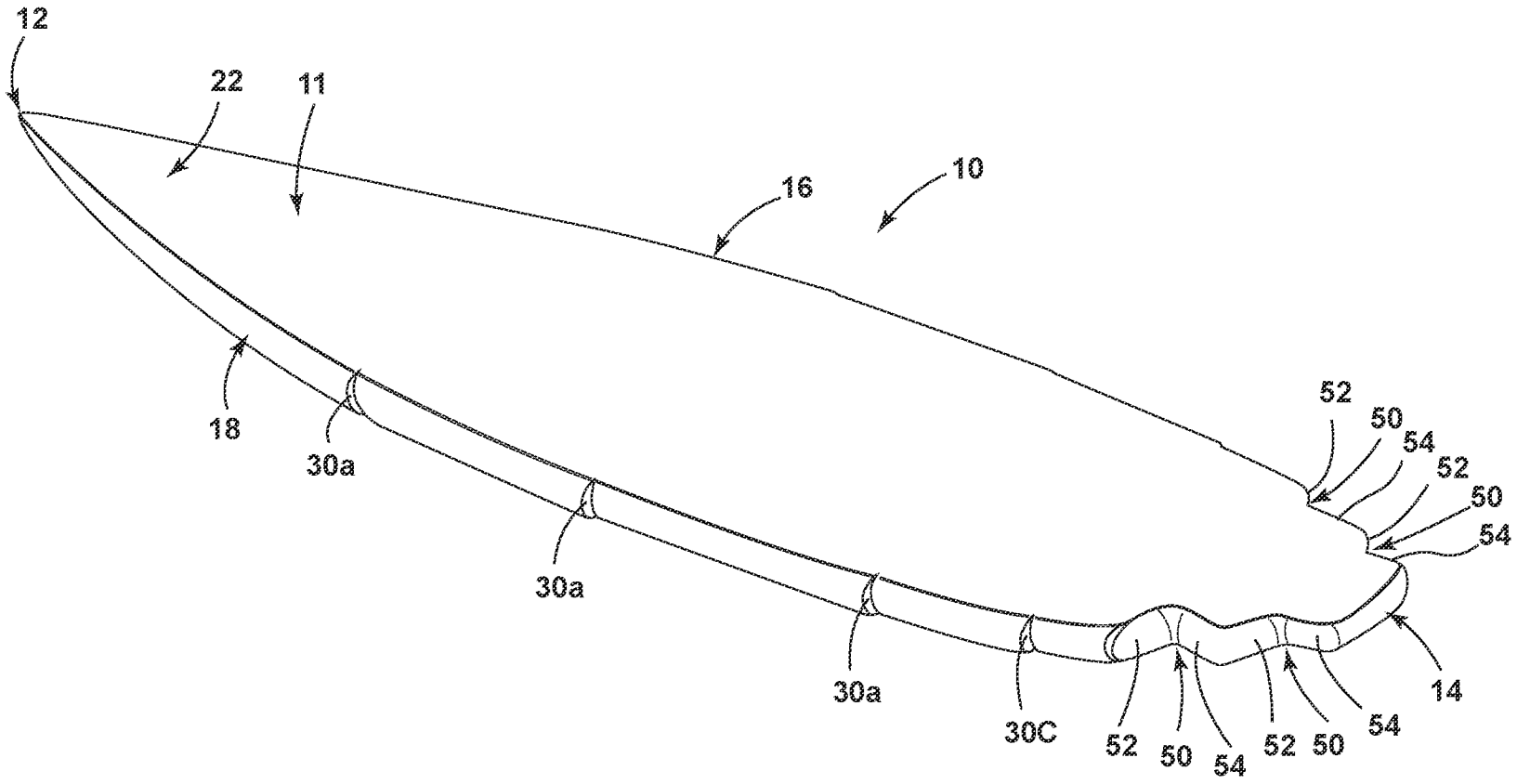
FIG. 3 illustrates a top perspective view of the wave riding board according to some embodiments of the present disclosure.
Figure 4:
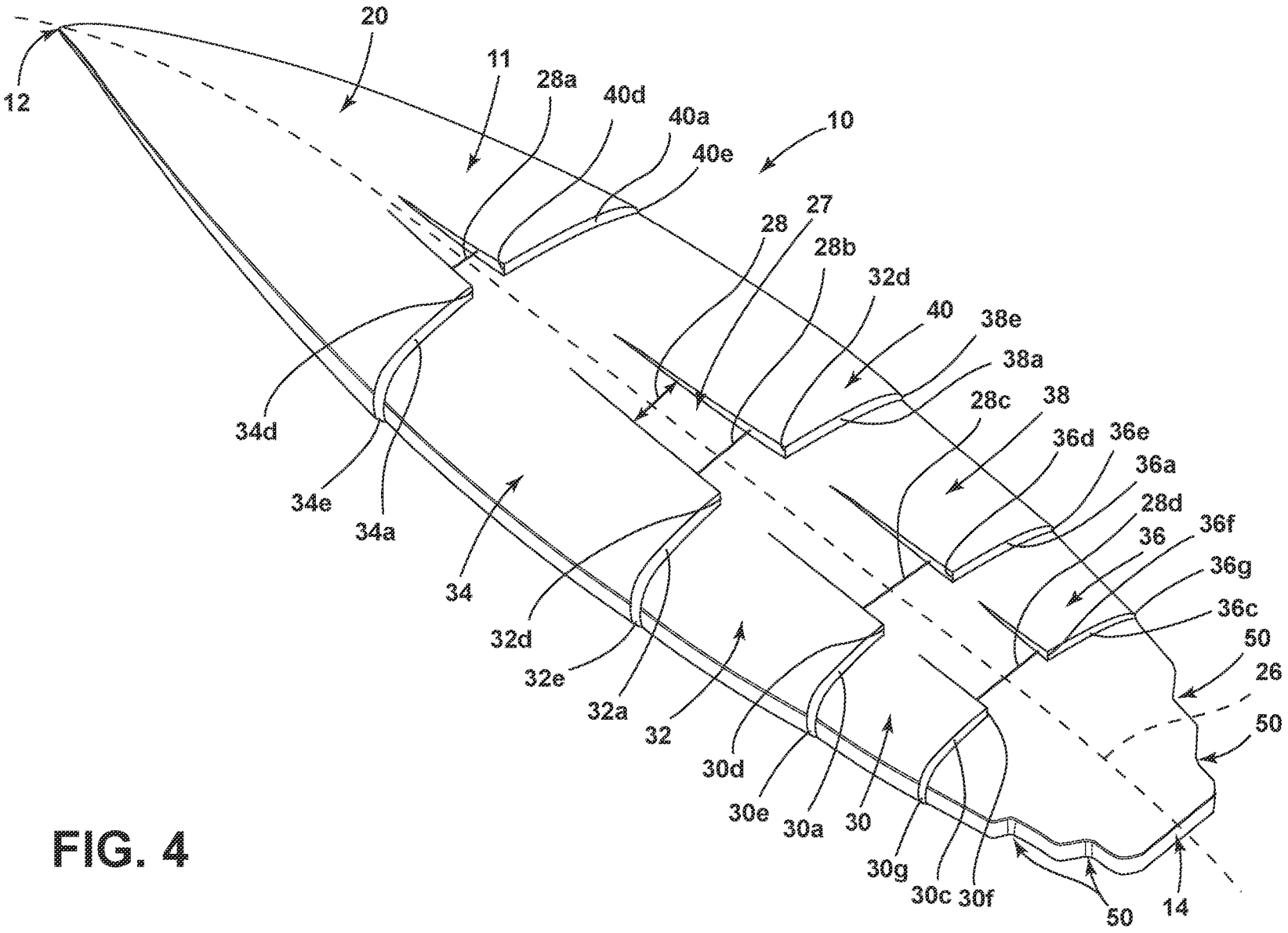
FIG. 4 illustrates a bottom perspective view of the wave riding board according to some embodiments of the present disclosure.
Figure 5:
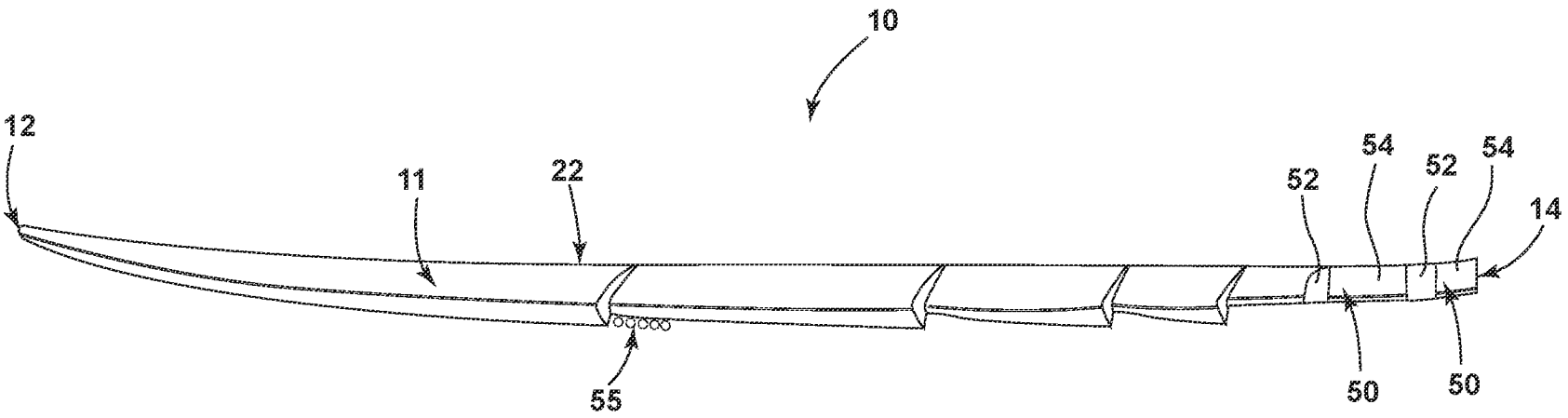
FIG. 5 illustrates a side perspective view of the wave riding board according to some embodiments of the present disclosure.

With reference to FIGS. 3-5, as described herein, one or more steps 30-40 can help prevent suction between the bottom 20 of the board 10 and the water on which the board 10 travels by creating breaks or voids between the bottom 20 of the board 10 and the water. The breaks allow air to be distributed efficiently under the bottom 20 of the board 10. When the board 10 moves against current or waves in the water, air flows under the steps 30-40 of the board 10 to create lift. When the board 10 moves with current or waves in the water (e.g., catching a wave in an ocean), water collides with lateral walls of the steps 30-40 to create additional thrust in the direction of the current or waves. The longitudinal distance between the lateral walls of the steps 30-40 can increase (going from the front 12 to the rear 14 of the board 10) to help eliminate hydrodynamic drag on the board 10.

Additionally or alternatively, to increase a surface area of each of the steps 30-40, at least one of the one or more steps 30-40 and/or the rear lateral walls 30*c* and 36*c* of the right rear side step 30 and left rear side step 36 can extend at least partially around the left edge 18 or the right edge 16 of the body 11. By increasing the surface area of each step 30-40 and/or the rear lateral walls 30*c* and 36*c* of the right rear side step 30 and left rear side step 36, additional water may contact the steps 30-40 when the board 10 moves with the current or waves to provide additional thrust. In addition, when the board 10 is rolled about the central axis 26 so that one edge 16, 18 is in the water and the other is at least partially above the surface of the water (i.e., the two sides of the board 10 and not vertically aligned with one another), the lower edge may have more thrust than the higher edge leading to faster turning characteristics for the board 10.

In the embodiment illustrated in FIGS. 3-5, the steps 30-40 extend to a position that is generally aligned with the top 22 of the body 11. However, it will be appreciated that the steps 30-40 may extend along a side of the hoard 10 to a position that is above or below the top 22 of the body 11 without departing from the scope of the present disclosure. Due to one or more steps 30-40 curving around a side of the board 10, in some embodiments, an upper portion of an internal edge portion 30*d*-40*d* of a step 30-40 and/or an internal edge portion 30*f*, 36*f* of the rear lateral walls 30*c* and 36*c* of the right rear side step 30 and left rear side step 36 may be positioned below a lower portion of an outer edge portion 30*e*-40*e* of the step 30-40 and/or a lower portion of an outer edge portion 30*g*, 36*g* of the rear lateral walls 30*c* and 36*e* of the right rear side step 30 and left rear side step 36. In addition, in various embodiments, a first step 34, 40 may define a first radius of curvature about the edge of the board 10, a second step 32, 38 may define a second radius of curvature that is less than the first radius, a third step 30, 36 may define a third radius of curvature that is less than the first or second radius, and the rear lateral walls 30*c* and 36*c* of the right rear side step 30 and left rear side step 36 may define a fourth radius of curvature that is less than the first, second, or third radius.

To create additional thrust, in some embodiments, such as those illustrated in FIGS. 3-5, the body 11 may define one or more notches 50, or indents, proximate the rear 14 of the body 11. Each notch may be defined by first and second offset walls 52, 54. The first wall 52 is positioned at least partially rearwardly such that water collides with the first wall 52 to create additional thrust when the board 10 moves with current or waves in the water. In some examples, the one or more notches 50 includes a first notch on a first side of the central axis 26 of the body 11 and a second notch on a second, opposing side of the central axis 26 of the body 11. In some examples, the notches 50 may alter steering characteristics of the board 10, For example, the notches 50 may assist in cutting water for altering the steering characteristics.

As described above, the channel 27 runs through or is defined at least partially between the longitudinal walls of each of the steps 30-40, and may have a width 28 that increases from the front 12 to the rear 14 of the body 11, thereby forming a substantially triangular or triangular-like shape. For example, the width 28 of channel 27 may gradually increase from width 28*a* at a front 12 of the body 11, to a width 28*b* between longitudinal walls 40*a* and 34*a*, to a width 28*c* between longitudinal walls 38*a* and 32*a*, to a width 28*d* between longitudinal walls 36*b* and 30*b*. When the board 10 moves against the waves or current in the water, the lateral and longitudinal walls of each step 30-40 create individual voids or spaces under the steps 30-40 so that air (e.g., air 57 illustrated in FIG. 2) can flow under one or more of the steps 30-40 of the board 10 and create lift, while water can simultaneously flow smoothly through the center channel 27. When the board 10 moves with the waves or current in the water, the water (e.g., water 55 illustrated in FIG. 5) can collide with one or more of the lateral walls of the steps 30-40 to create additional thrust in the direction of the waves or current. Further, in some embodiments, when traveling with the waves or current, water floods into the larger, back end of the channel 27 and is condensed as it pools into the smaller, front end of the channel 27, which can also create additional thrust.

Figure 6:
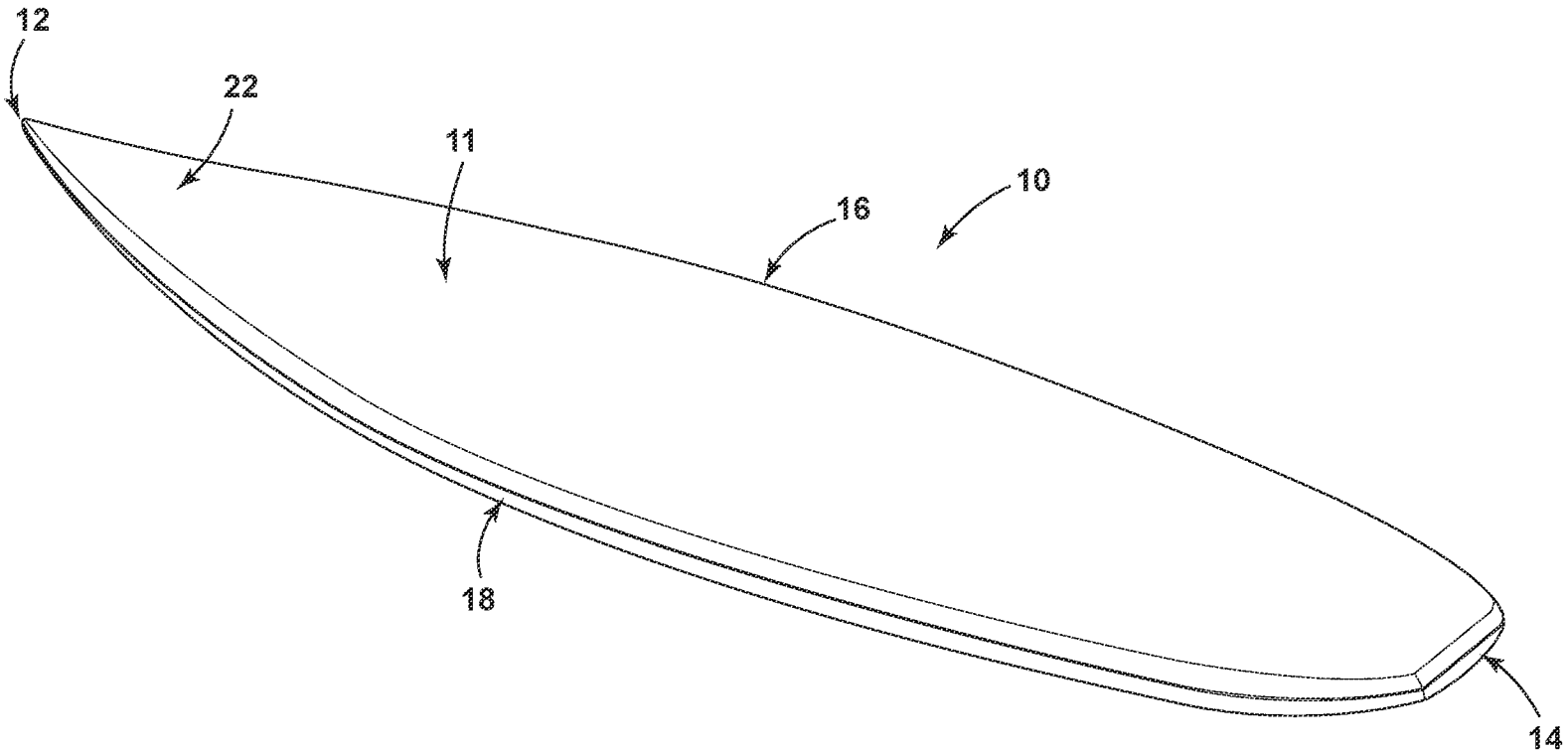
FIG. 6 illustrates a top perspective view of the wave riding board according to some embodiments of the present disclosure.
Figure 7:
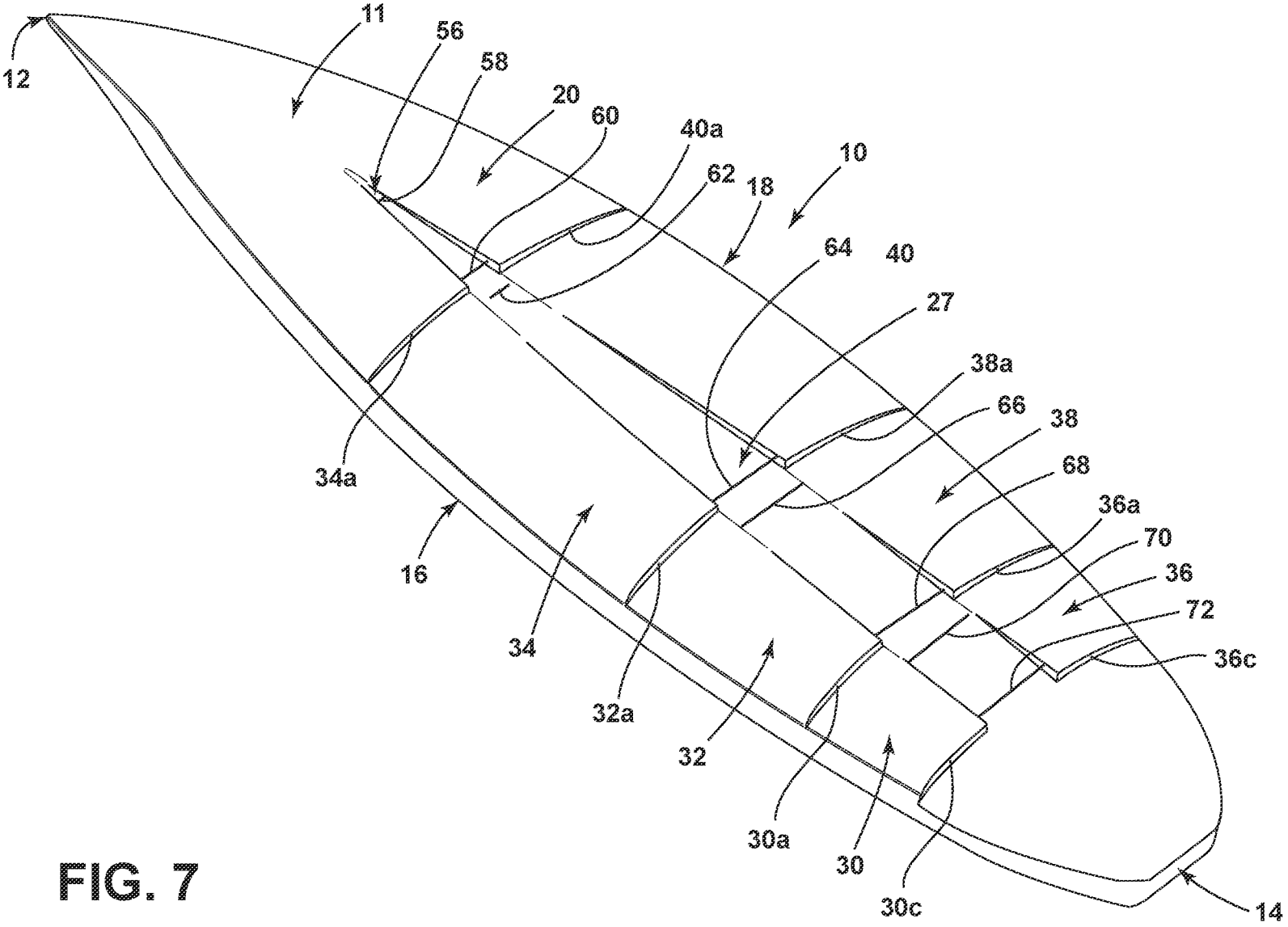
FIG. 7 illustrates a bottom perspective view of the wave riding board according to some embodiments of the present disclosure.
Figure 8:
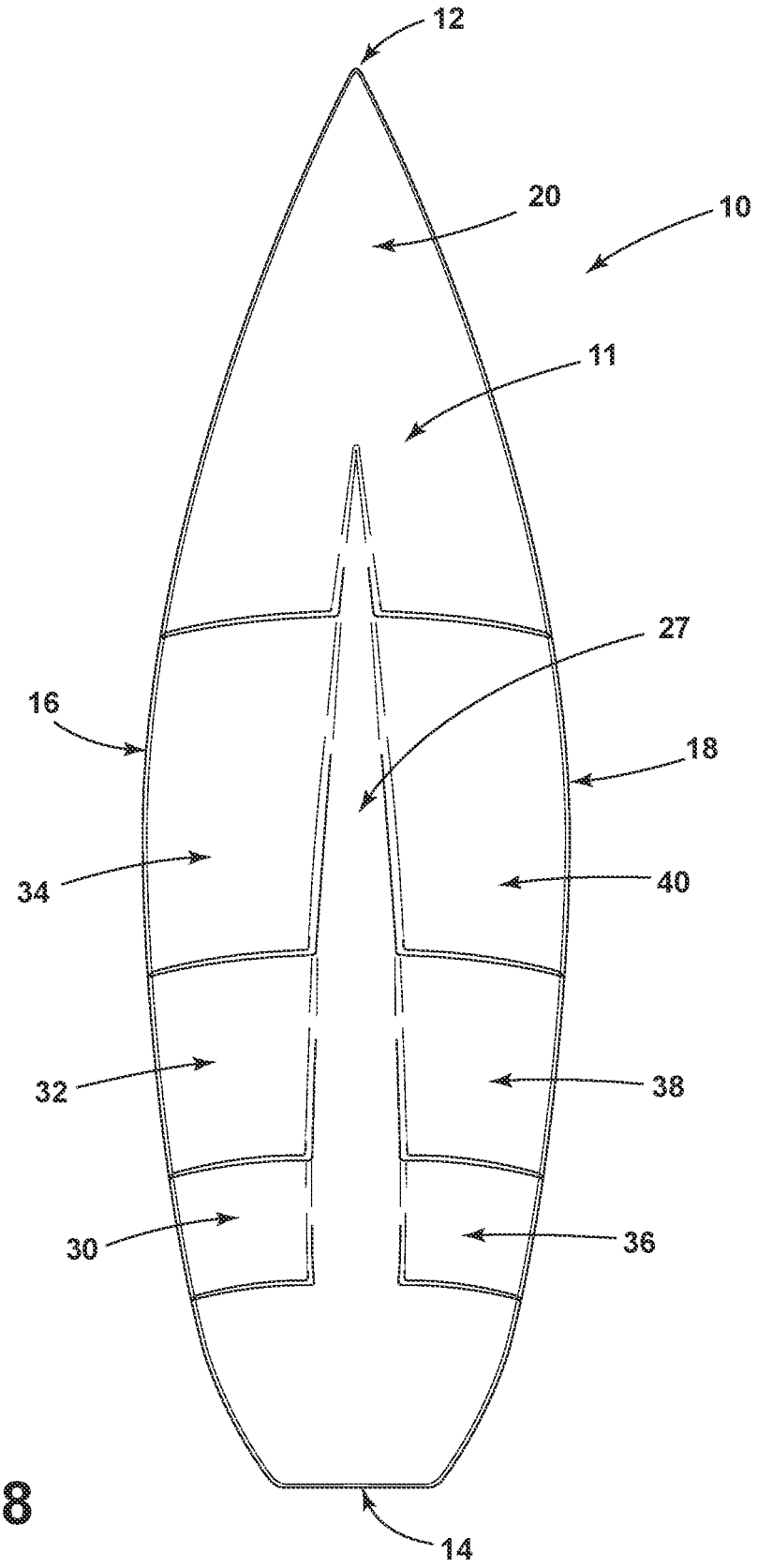
FIG. 8 illustrates a bottom perspective view of the wave riding board according to some embodiments of the present disclosure.

With reference to FIGS. 6-8, in some embodiments, the steps 30-40 may terminate at a position below the top 22 leading to the body 11 having a generally continuous curvature on opposing edges 16, 18 thereof. In addition, the board 10 may be free of notches 50 proximate the rear end portion thereof.

In some embodiments, such as the examples illustrated in FIGS. 6-8, the channel 27 may have a width that increases between each set of laterally spaced steps 30-40. In some embodiments, a forward portion 56 of the channel 27 proximate the front 12 of the board 10 may have a first width 58 and the rear portion may have a second larger width 60 rearwardly of the first width 58. A forward portion of the channel 27 between a first pair of steps 34, 40 may have a third width 62 and the rear portion may have a fourth larger width 64. A forward portion of the channel 27 between a second pair of steps 32, 38 may have a fifth width 66 and the rear portion may have a sixth larger width 68. A forward portion of the channel 27 between a third pair of steps 30, 36 may have a seventh width 70 and the rear portion may have an eighth larger width 72. In some examples, the third width 62 may be greater than the first width 58 and less than the second width 60, the fifth width 66 may be greater than the third width 62 and less than the fourth width 64, and the seventh width 70 may be greater than the fifth width 66 and less than the sixth width 68. However, the channel 27 may be of any shape and any portion may have any width without departing from the scope of the present disclosure. In addition, it will be appreciated that the board 10 illustrated in FIGS. 6-8 may have any of the features described in reference to FIGS. 1-5.

Figure 9:
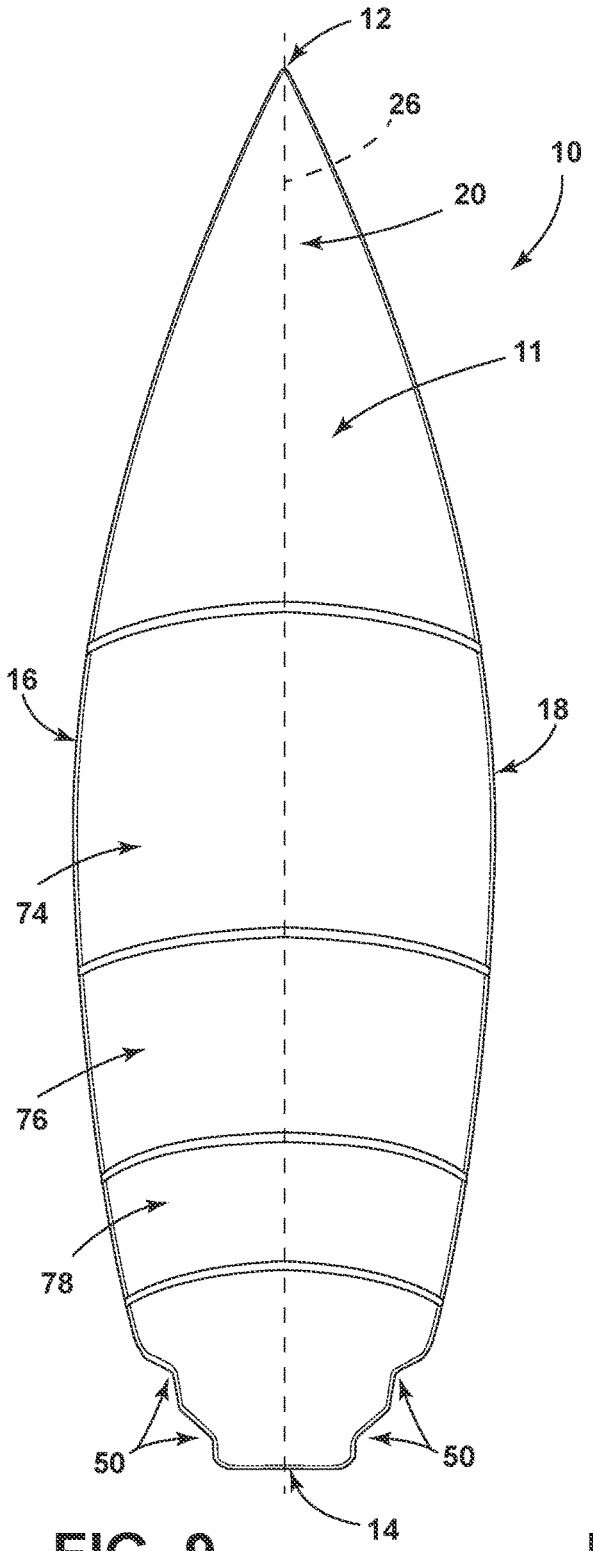
FIG. 9 illustrates a bottom plan view of the wave riding board according to some embodiments of the present disclosure.
Figure 10:
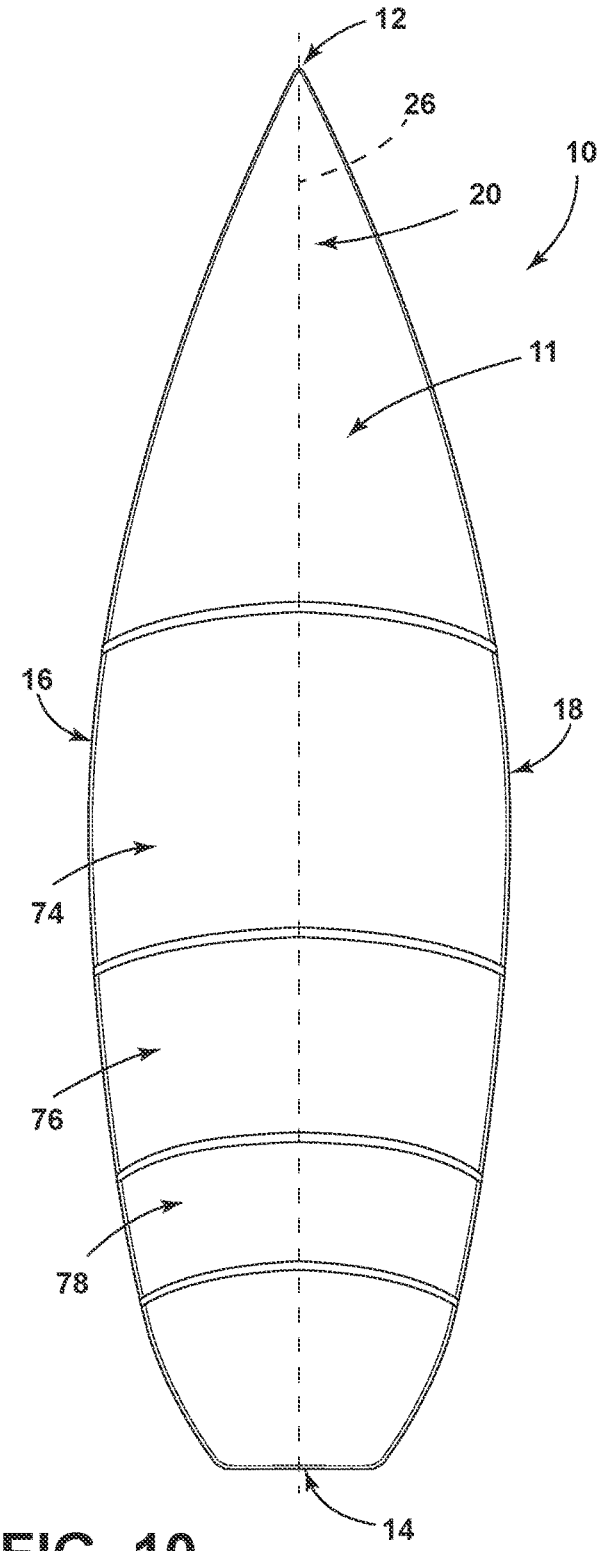
FIG. 10 illustrates a bottom perspective view of the wave riding board according to some embodiments of the present disclosure.

In various embodiments, the board 10 may include any number of channels 27, For example, as generally illustrated in FIGS. 9 and 10, the board 10 may be free of channels 27 and each of the steps 30-40 may extend from one side of the board 10 to the opposite side of the board 10. In other examples, such as the ones generally illustrated in FIGS. 11 and 12, the board 10 may include a pair of channels 27*a*, 27*b* that are separated from one another and positioned on opposing sides of the central axis 26 of the body 11. Likewise, in the embodiment illustrated in FIGS. 13 and 14, the board 10 defines three channels 27*a*, 27*b*, 27*c*. As provided herein, the bottom 20 of the boards 10 described herein may be convexly shaped, may curve laterally from the right edge 16 to the left edge 18, and may curve longitudinally from the front 12 to the rear 14. The center portion of the body 11 may be thicker than right or left portions of the body 11 (i.e., the body 11 may be thinner going from the center to each of the right edge 16 and the left edge 18).

With further reference to FIGS. 9 and 10, the steps 74-78 of the board 10 generally extend from one side of the board 10 to an opposing side and include one or more steps 74-78. In various examples, the central axis 26 of the body 11 defines a first lateral side on the first side of the lateral axis and a second lateral side on the opposing side of the lateral axis. The first and second sides of each step 74-78 may be mirrored structures of one another. As provided herein, any of the steps 74-78 may generally be positioned on the bottom of the board 10 and/or extend about an edge 16, 18 of the board 10. In some examples, some steps any of the steps 74-78 may extend at least partially about an edge 16, 18 of the board while other steps 74-78 are positioned along the bottom of the board 10 and generally terminate prior to extending around the edge 16, 18.

Figure 11:
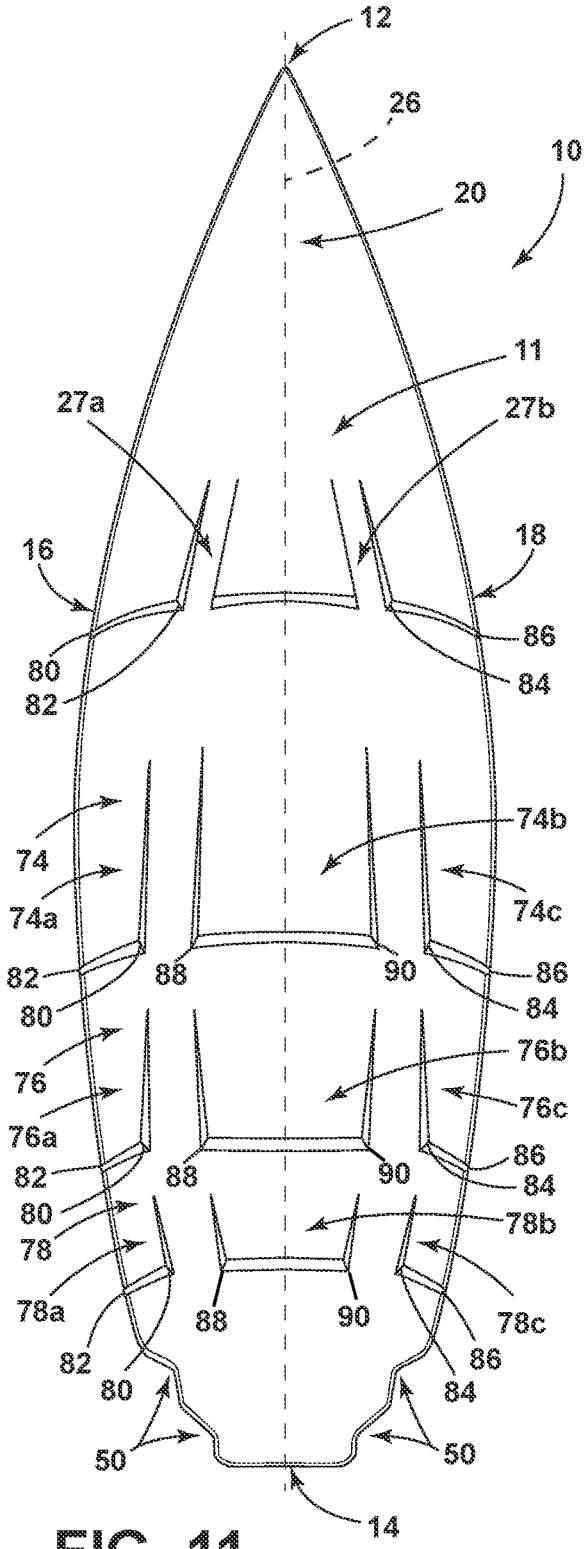
FIG. 11 illustrates a bottom plan view of the wave riding board according to some embodiments of the present disclosure.
Figure 12:
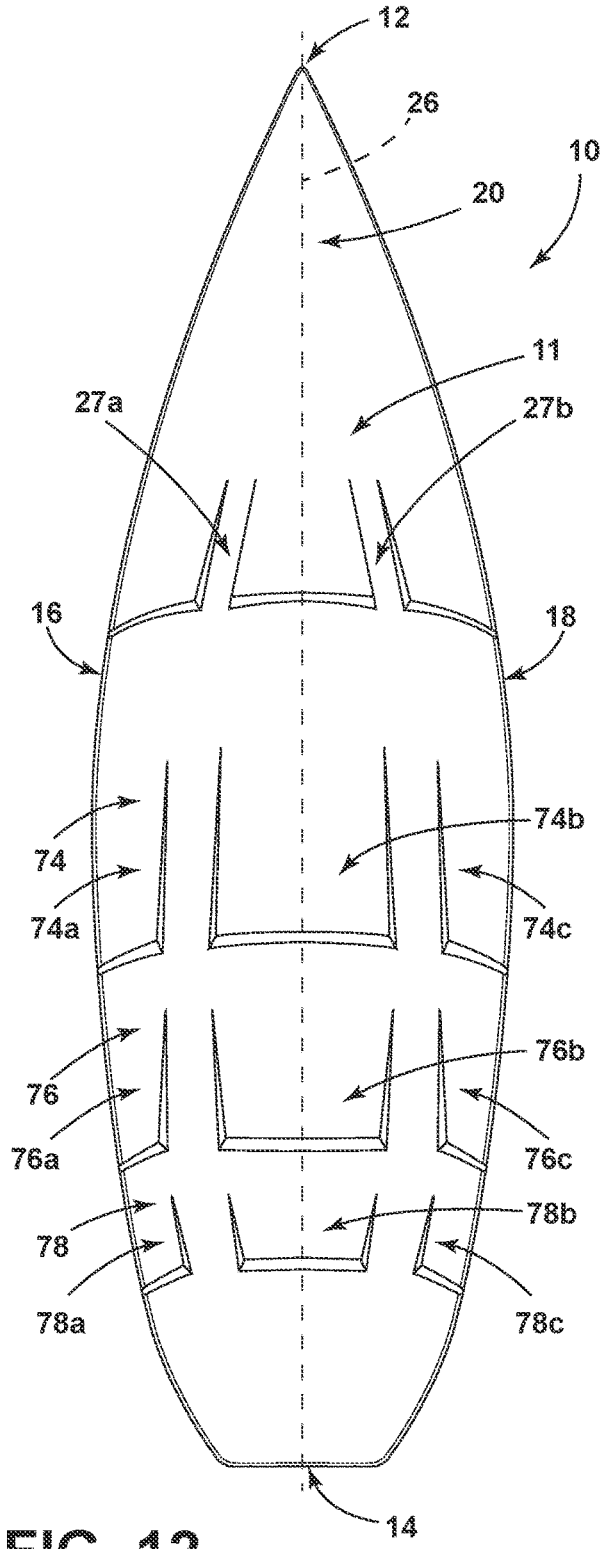
FIG. 12 illustrates a bottom plan view of the wave riding board according to some embodiments of the present disclosure.

In some embodiments, such as those illustrated in FIGS. 11 and 12, the board 10 includes one or more steps 74-78 and a pair of channels 27*a*, 27*b*. In such instances, the board 10 may include a first set of steps 74 that includes a right step 74*a*, an intermediate step 74*b*, and a left step 74*c*; a second set of steps 76 that includes a right step 76*a*, an intermediate step 76*b*, and a left step 76*c*; a third set of steps 78 that includes a right step 78*a*, an intermediate step 78*b*, and a left step 78*c*. In some embodiments, each of the right steps 74*a*, 76*a*, 78*a* and intermediate steps 74*b*, 76*b*, 78*b* may be separated by a first channel 27*a* and each of the left steps 74*c*, 76*c*, 78*c* and the intermediate steps 74*b*, 76*b*, 78*b* may be separated by a second channel 27*b*. The first and second channels 27*a*, 27*b* may be positioned on opposing sides of the central axis 26 of the body 11. In various embodiments, the first and/or second channels 27*a*, 27*b* may be non-linear, and thus, non-parallel to the central axis 26. In addition, the channels 27*a*, 27*b* may be mirror images of one another, as illustrated in FIGS. 11 and 12. However, in other embodiments, the first and second channels 27*a*, 27*b* may vary in shape.

In some embodiments, such as those illustrated in FIGS. 11 and 12, each of the right steps 74*a*, 76*a*, 78*a* defines a first thickness 80 on a first, interior side of each left step and a second thickness 82 on a second, exterior side of each right step 74*a*, 76*a*, 78*a*. The second thickness 82 may be less than, equal to, or greater than the first thickness 80. Likewise, each of the left steps 74*c*, 76*c*, 78*c* may define a third thickness 84 on a first, interior side of each left step 74*c*, 76*c*, 78*c* and a fourth thickness 86 on a second, exterior side of each left step 74*c*, 76*c*, 78*c*. The fourth thickness 86 may be less than, equal to, or greater than the third thickness 84. In contrast, each intermediate step 74*b*, 76*b*, 78*b* may include first and second opposing end portions defining a generally common thickness 88, 90. However, each intermediate step 74*b*, 76*b*, 78*b* may include first and second opposing end portions having a varied thickness without departing from the teachings provided herein.

With further reference to FIGS. 11 and 12, any of the steps 74, 76, 78, for example, each of the intermediate steps 74*c*, 76*c*, 78*c* may have a base portion having a wider lateral width than an outer portion causing the step 74*c*, 76*c*, 78*c* to have a generally trapezoidal cross section. The generally trapezoidal cross section may assist in steering the board 10 in a direction that is generally aligned with the central axis 26 of the body 11 when water collides with the board 10.

Figure 13:
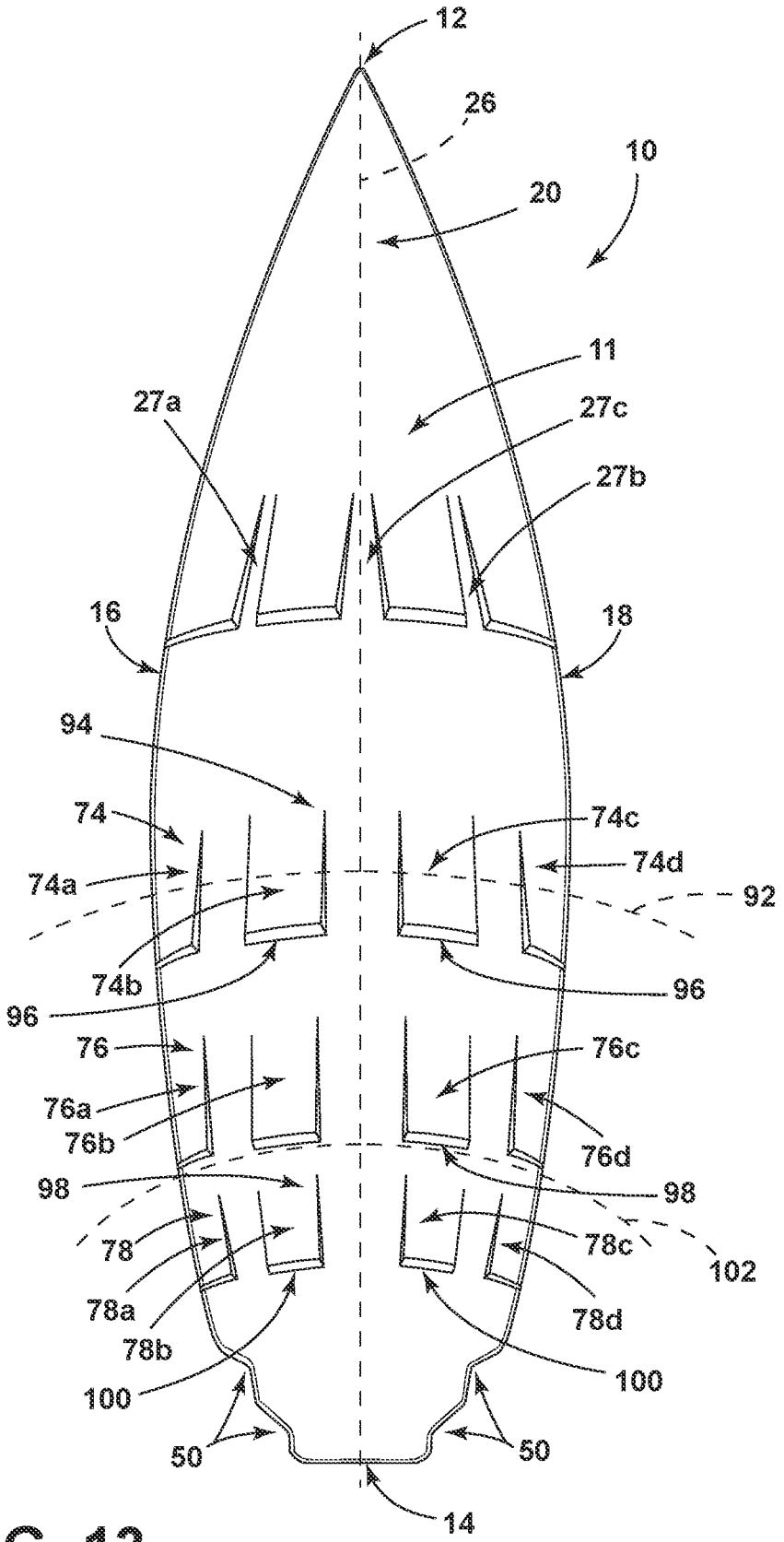
FIG. 13 illustrates a bottom plan view of the wave riding board according to some embodiments of the present disclosure.
Figure 14:
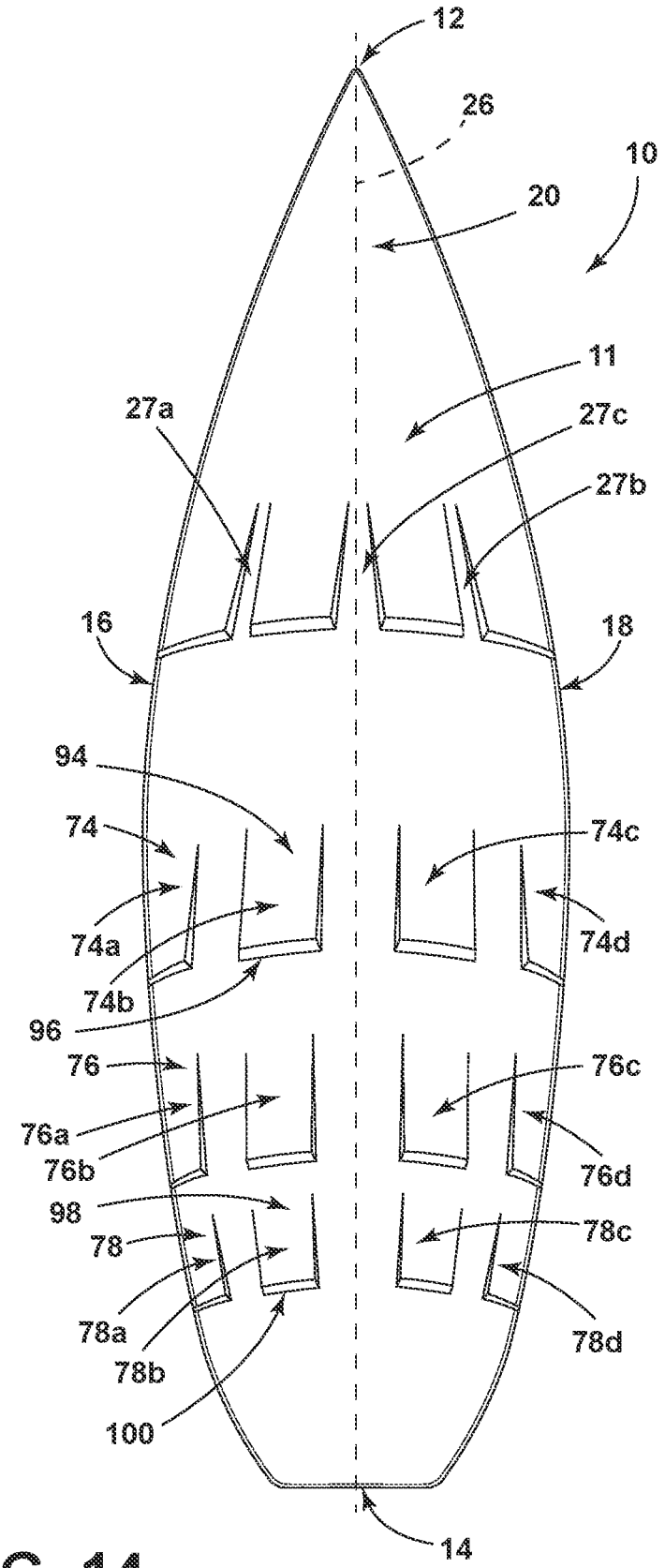
FIG. 14 illustrates a bottom plan view of the wave riding board according to some embodiments of the present disclosure.

With reference to FIGS. 13 and 14, in some embodiments, the body 11 of the board 10 may define three, or more, channels 27*a*, 27*b*, 27*c*. In some instances, the body 11 may include first and second channels 27*a*, 27*b* that are separated by a third, or center, channel 27*c*. The first, second, and third Channels 27*a*, 27*b*, 27*c* may generally define first, second, and third respective widths. The third width may be greater than, equal to, or less than the first or second width along at least a portion of the channel 27*c*, or when the first, second, third widths are measured along a common plane 92 that is transverse to the central axis 26 of the body 11. In some examples, a first portion of the central channel 27*c* may be defined by a pair of intermediate steps 74*b*, 74*c*, 76*b*, 76*c*, 78*b*, 78*c* and have a forward portion of a third width and a second portion of a fourth width greater than the third width. The first or second channels 27*a*, 27*b* may have a forward portion having a fifth width and a rear portion of a sixth width. In various embodiments, the fifth or sixth widths may be larger than the third width. Additionally or alternatively, the fifth or sixth widths may be smaller than the fourth width. However, in non-illustrated examples, any of the widths may be of a common size without departing from the scope of the present disclosure.

In some embodiments having three or more channels, each set of steps may include more than one intermediate step. For example, in the embodiments illustrated in FIGS. 13 and 14, each set of steps 74, 76, 78 includes a pair of intermediate steps 74*b*, 74*c*, 76*b*, 76*c*, 78*b*, 78*c*. In some examples, a first step (e.g., 74) includes a front portion 94 that is laterally closer to a central axis 26 of the body 11 than a rear portion 96 of the first step and a second step (e.g., 78) includes a front portion 98 that is laterally further from the central axis 26 than a rear portion 100 of the second step. In some examples, the first and second steps may be generally parallel to the central axis 26 or extend in any other direction without departing from the scope of the present disclosure.

With further reference to FIGS. 13 and 14, any set of steps on the body 11 may be oriented in along a common curve 102, along a common straight line, or offset from each other in any practicable fashion. In embodiments in which sets of steps are positioned along a common curvature, as generally illustrated in FIGS. 13 and 14, the central axis 26 may be coplanar with the radius of the curvature.

It should further be appreciated that the wave riding board 10 of the present disclosure may comprise any material suitable for wave riding. In some examples, the board 10 may include one or more of mushroom, fungus, wood, balsa wood, fiberglass, carbon fiber, EPS (expanded polystyrene), any resin, any polymer, any plastic, any bio-resin, any bio-polymer, any epoxy, and polyurethane, along with other material(s).

The board may include any of the features described herein in any combination without departing from the scope of the present disclosure. For example, the board may include one or more steps and/or one or more channels that help prevent suction between the bottom portion of the board and the water on which the board travels by creating breaks or voids between the bottom portion of the board and the water. The breaks allow air to be distributed efficiently under the bottom portion of the board. When the board moves against current or waves in the water, air flows under the steps of the board to create lift while water can simultaneously flows smoothly through any number (i.e., zero, one, two, three, etc.) of channels reducing the amount of energy or force required to paddle into the waves or current. When the board moves with current or waves in the water (e.g., catching a wave in an ocean), water collides with lateral walls of the steps to create additional thrust in the direction of the current or waves. Additionally or alternatively, the body of the board may define one or more notches proximate a rear portion of the board to create additional thrust in the direction of the current or waves when the water contacts various walls forming the notches. Additionally or alternatively, in some embodiments, the steps of the board may extend about an edge of the board to further create surfaces that are capable of creating additional thrust in the direction of the current or waves when the water contacts the steps. Moreover, the extension of the steps along an edge of the board may provide unique performance characteristics, such as faster turning capabilities when the board is rolled towards one of the edges.

The board described herein may have additional components mounted thereto in some examples. For example, any leash and/or fin may be mounted to any portion of the board. The positioning of the additional components may vary based on user preferences. In addition, the board provided herein may additionally or alternatively be utilized as a hull for any other marine vessel without departing from the scope of the present disclosure. In various examples, the marine vessel may be any device or structure that is capable of at least partially supporting an object above a water surface.

It will be understood by one having ordinary skill in the art that construction of the described invention and other components is not limited to any specific material. Other exemplary examples of the invention disclosed herein may be formed from a wide variety of materials unless described otherwise herein.

For purposes of this disclosure, the term "coupled" (in all of its forms: couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

Furthermore, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected" or "operably coupled" to each other to achieve the desired functionality, and any two components capable of being so associated can also be viewed as being "operably couplable" to each other to achieve the desired functionality. Some examples of operably couplable include, but are not limited to, physically mateable and/or physically interacting components and/or wirelessly interactable and/or wirelessly interacting components and/or logically interacting and/or logically interactable components.

It is also important to note that the construction and arrangement of the elements of the invention as shown in the exemplary examples is illustrative only. Although only a few examples of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connectors or other elements of the system may be varied, the nature or number of adjustment positions provided between the elements may be varied. It should be noted that the elements and/or assemblies of the system might be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary examples without departing from the spirit of the present innovations.

It will be understood that any described processes or steps within described processes may be combined with other disclosed processes or steps to form structures within the scope of the present invention. The exemplary structures and processes disclosed herein are for illustrative purposes and are not to be construed as limiting.

It is also to be understood that variations and modifications can be made on the aforementioned structures and methods without departing from the concepts of the present invention, and further it is to be understood that such concepts are intended to be covered by the following claims unless these claims by their language expressly state otherwise.

What is claimed is:

1. A wave riding board comprising:

a body including a top, a bottom, a right edge, a left edge, a front, a rear, and a length defined from the front to the rear, the bottom of the body including one or more steps and a first channel defined at least partially between the one or more steps, the first channel extending along at least a portion of the length of the body, wherein at least one of the one or more steps extends at least partially around the left edge or the right edge of the body.

2. The wave riding board of claim 1, wherein the first channel is located at a center portion of the bottom of the body.

3. The wave riding board of claim 1, further comprising:

second and third channels each defined at least partially between the one or more steps, wherein the second channel is positioned on a first side of the first channel and the third channel is positioned on a second side of the first channel.

4. The wave riding board of claim 3, wherein:

a depth of each present channel at one or more locations is defined by heights of at least two steps at each of the one or more locations, a width of each present channel is defined at the one or more locations by a lateral distance between a pair of opposing steps at opposite sides of that channel at each of the one or more locations.

5. The wave riding board of claim 1, wherein the first channel defines a substantially triangular-like shape.

6. The wave riding board of claim 1, wherein the one or more steps includes a first step and a second step positioned closer to the rear of the body than the first step.

7. The wave riding board of claim 6, wherein the first step defines a first radius of curvature about an edge of the board that corresponds to said first step, and the second step defines a second radius of curvature about an edge of the board corresponding to said second step that is smaller than the first radius.

8. The wave riding board of claim 6, wherein an upper portion of an internal edge portion of the first step is positioned below a lower portion of an outer edge of the first step.

9. The wave riding board of claim 6, wherein the first step includes a front portion that is laterally closer to a central axis of the body than a rear portion of the first step, and a second step includes a front portion that is laterally farther from the central axis than a rear portion of the second step.

10. The wave riding board of claim 1, wherein the body defines one or more notches in at least one of the right edge and the left edge between the rear and the one or more steps.

11. The wave riding board of claim 1, wherein at least two steps of the one or more steps extend laterally from an edge of the first channel to a corresponding edge of the body in a direction substantially perpendicular to the length of the body.

12. A wave riding board comprising:

a body including a top, a bottom, a right edge, a left edge, a front, a rear and a length defined from the front to the rear, the bottom of the body including one or more steps, wherein the body defines one or more notches in at least one of the right edge or the left edge between the rear and the one or more steps.

13. The wave riding board of claim 12, wherein the one or more steps includes first and second steps, and a longitudinal distance of the first step is greater than a longitudinal distance of the second step.

14. The wave riding board of claim 13, wherein:

a longitudinal distance between the first step and the front of the body is shorter than a longitudinal distance between the first step and the rear of the body; and a longitudinal distance between the second step and the front of the body is greater than a longitudinal distance between the second step and the rear of the body.

15. The wave riding board of claim 12, wherein each of the one or more notches is defined by first and second offset walls, the first wall positioned at least partially rearwardly.

16. The wave riding board of claim 12, wherein the one or more notches includes a first notch on a first side of a central axis of the body and a second notch on a second, opposing side of the central axis of the body.

17. The wave riding board of claim 12, wherein at least one of the one or more steps extends at least partially around the left edge or the right edge of the body.

18. A wave riding board comprising:

a body including a top, a bottom, a right edge, a left edge, a front, a rear, and a length defined from the front to the rear, the bottom of the body including one or more steps and a pair of channels defined at least partially between the one or more steps, wherein a first channel is positioned on a first side of a central axis of the body and a second channel is positioned on a second side of the central axis.

19. The wave riding board of claim 18, wherein at least one of the one or more steps extends at least partially around the left edge or the right edge of the body.

20. The wave riding board of claim 18, wherein the body defines one or more notches in at least one of the right edge and the left edge between the rear and the one or more steps.

21. The wave riding board of claim 18, wherein the body further defines a third channel positioned between the first and second channels.

22. The wave riding board of claim 21, wherein the first, second, and third channels channel respectively define first, second, and third widths and the third width is greater than the first width or the second width along at least a portion of the channel.

23. The wave riding board of claim 18, wherein the one or more steps includes a left step defining a first thickness on a first, interior side thereof and a second thickness on a second, exterior side thereof, wherein the second thickness is smaller than the first thickness, a right step defining a third thickness on a first, interior side thereof and a fourth thickness on a second, exterior side thereof, wherein the fourth thickness is smaller than the third thickness, and an intermediate step positioned between the left step and the right step and including first and second opposing end portions defining a generally common thickness.

* * * * *